US007603755B2

(12) United States Patent
Gordon

(10) Patent No.: US 7,603,755 B2
(45) Date of Patent: Oct. 20, 2009

(54) METHOD OF PRODUCING A TWILL WEAVE FABRIC WITH A SATIN FACE

(75) Inventor: Dean Gordon, Hickory Grove, SC (US)

(73) Assignee: Northeast Textiles, Inc., Bowling Green, SC (US)

( * ) Notice: Subject to any disclaimer, the term of this patent is extended or adjusted under 35 U.S.C. 154(b) by 506 days.

(21) Appl. No.: 11/511,967

(22) Filed: Aug. 29, 2006

(65) Prior Publication Data

US 2008/0052884 A1 Mar. 6, 2008

(51) Int. Cl.
*D06C 27/00* (2006.01)

(52) U.S. Cl. ..... 26/28; 28/163; 28/165

(58) Field of Classification Search ..... 26/28, 26/27, 51, 52, 89, 92, 29 R, 30; 28/163, 28/165, 140; 139/1 R, 291 R, 307, 383 R; 451/54, 57

See application file for complete search history.

(56) References Cited

U.S. PATENT DOCUMENTS

| | | | | |
|---|---|---|---|---|
| 3,523,346 | A * | 8/1970 | Bolen et al. | 28/163 |
| 3,973,359 | A * | 8/1976 | Spencer et al. | 451/183 |
| 4,103,054 | A * | 7/1978 | Okamoto et al. | 428/91 |
| 4,145,467 | A * | 3/1979 | Malik | 26/29 R |
| 4,316,928 | A * | 2/1982 | Otto | 442/195 |
| 5,815,896 | A * | 10/1998 | Dischler | 26/28 |
| 6,233,795 | B1 * | 5/2001 | Dischler | 26/28 |
| 6,242,370 | B1 * | 6/2001 | Dischler | 26/28 |
| 7,055,227 | B2 * | 6/2006 | Love et al. | 28/167 |
| 2003/0154580 | A1 * | 8/2003 | Overcash et al. | 26/27 |
| 2004/0229538 | A1 * | 11/2004 | Love et al. | 442/182 |
| 2008/0227351 | A1 * | 9/2008 | Park et al. | 442/192 |

* cited by examiner

*Primary Examiner*—Amy B Vanatta
(74) *Attorney, Agent, or Firm*—J. Bennett Mullinax, LLC

(57) ABSTRACT

A method of forming a fabric is provided. The method includes the step of providing a plurality of yarn and batching the yarn on an A-frame so that the fabric is formed with a width greater than 102 inches and with a twill weave with a satin face. Also included is the step of passing the fabric across a plurality of rolls that have a rough surface and that apply compression to the fabric. The steps of applying fabric to a tenter frame and heating of the fabric is also included. The present invention also provides for a fabric in certain exemplary embodiments.

16 Claims, 2 Drawing Sheets

METHOD OF PRODUCING A TWILL WEAVE FABRIC WITH A SATIN FACE

FIELD OF THE INVENTION

The present invention relates generally to a method of producing a twill weave fabric that has a satin face. More particularly, the present application involves a method of producing a 3/1 or 4/1 twill weave fabric with a satin face that has a large width which permits the seamless production of draperies, comforters, curtains, and other large finished fabric articles.

BACKGROUND

Fabric is a man-made flexible material composed of a network of artificial or natural fibers. The network of fibers can be made through the process of weaving or knitting. Fabrics can be constructed in a variety of manners in order to achieve various properties. For example, when incorporated into curtains the fabric can be designed in order to be opaque to block outside light. Further, the fabric can be constructed to have a high quality hand feel for items such as a bed comforter which improves the comfort and feel of the comforter. Consumers perceive a fabric that has "good hand" properties as a higher quality product and, thus, it is an important consideration in the consumer's selection of a fabric.

A weave pattern of the fabric includes a plurality of yarn pieces that are parallel to one another and are known as warp yarns. The warp yarns are usually oriented perpendicular to another plurality of parallel yarns known as weft yarns. The warp and weft yarns overlay and underlay one another in particular patterns in order to result in the weave pattern of the fabric. The weave pattern repeats throughout the fabric, and the ends per weave repeat is the number of warp yarns that are present in one repeating pattern.

Fabric that has a twill weave is generally structured so that two or three warp yarns are positioned over a weft yarn. Further, one or two warp yarns are positioned under the respective weft yarn. Fabrics with a twill weave are generally more wrinkle resistant, more durable, and are more resistant to showing soil than fabrics with a plain weave. Additionally, twill weave fabrics have fewer interlacings, are more pliable and have better hand feel than plain weave fabrics. Satin weave fabrics typically have a structure in which interlacings float over four or more yarns. As such, satin weave fabrics usually have floats that may be 3/1, 4/1, 7/1 and 11/1. These types of fabrics are typically flat with a smooth, lustrous surface.

Fabrics are treated during the production process in order to achieve or enhance various properties. For example, the fabric may be sanded, heated, stretched or treated with a chemical agent. Fabric for use in curtains, for instance, can be selected as a 3/1 or 4/1 twill weave fabric with a satin face and may be treated during the production process with an agent for inducing soil release. Such fabrics can have variously designed print patterns imparted thereon and once formed can be sewn together to be used in a curtain of a desired length. Formation of curtains or bed spreads in this manner may be problematic in that a great deal of care and time must be used in order to make the print patterns line up between successive fabric pieces. Additionally, the presence of seam lines in the final product may be undesirable to the end user. It is currently not feasible to produce fabrics in greater widths to alleviate these problems as roller oscillation occurs with fabrics of greater width resulting in uneven surface finishes of the final product.

As such, there remains room for variation and improvement within the art.

SUMMARY

Various features and advantages of the invention will be set forth in part in the following description, or may be obvious from the description, or may be learned from practice of the invention.

One aspect of the present invention provides for a method of finishing a fabric that has a twill weave with a satin face. The method includes the steps of providing a fabric that has a width from 102 to 131 inches. Additional steps include sewing and batching the fabric on an A-frame. The fabric is passed at a speed of 20 yards per minute with a first roll that has a 120 grit sand paper surface and that rotates in a counter clockwise direction. The first roll applies 3 inches of compression to the fabric. The fabric engages a second roll that has a 100 grit sand paper surface and that rotates in a clockwise direction. The second roll applies 7 inches of compression to the fabric. The fabric also engages a third roll that has a 100 grit sand paper surface and that rotates in the clockwise direction. The third roll applies 7 inches of compression to the fabric. The fabric also engages a fourth roll that has a 120 grit sand paper surface and that rotates in a counterclockwise direction. The fourth roll applies 5 inches of compression to the fabric. The method also includes applying the fabric to a tenter frame and stretching the fabric by 2% of the fabric's relaxed length. The fabric is moved at a speed from 15 to 35 yards per minute. Another step involves applying an agent to the fabric to improve pilling properties of the fabric. A further step includes heating of the fabric to a temperature of 385 degrees Fahrenheit.

Another aspect of the present invention is found in a method of forming a fabric that includes the step of providing a plurality of yarn. The method also includes batching the yarn on an A-frame so that the fabric is formed with a width greater than 102 inches and with a twill weave with a satin face. Also included in the method is the step of passing the fabric across a plurality of rolls that have a rough surface in which the rolls apply compression to the fabric. Additional steps involve applying the fabric to a tenter frame and heating of the fabric.

A further aspect of the present invention is found in a method as immediately discussed that further has the step of sanding the fabric at a speed of 20 yards per minute.

An additional aspect of the present invention exists in a method as previously discussed in which the passing step includes the passing of the fabric across a first roll that has a 120 grit sand paper surface and that rotates in a first direction. The first roll applies at least 3 inches of compression to the fabric. The passing step also involves passing the fabric across a second roll that has a 100 grit sand paper surface and that rotates in a second direction. The second roll applies at least 7 inches of compression to the fabric. Also included in the passing step is the action of passing the fabric across a third roll that has a 100 grit sand paper surface and that rotates in the second direction. The third roll applies at least 7 inches of compression to the fabric. Also included in the passing step is the passing of the fabric across a fourth roll that has a 120 grit sand paper surface and that rotates in the first direction. The fourth roll applies at least 5 inches of compression to the fabric.

Another aspect of the present invention is found in a method as previously discussed in which the applying step includes stretching of the fabric by 2% of the fabric's relaxed length.

The present invention provides for in another aspect a method as previously discussed that further includes the application of an agent to the fabric. The agent acts to improve the soil release and pilling properties of the fabric.

Another aspect of the present invention is found in a method as discussed above in which the fabric is formed in the sewing and batching step so as to have a float of 3/1.

Another aspect of the present invention exits in a method as previously mentioned in which the fabric is formed in the sewing and batching step so as to have a float of 4/1.

An additional aspect of the present invention is found in a method mentioned prior in which the width of the fabric is 124 inches.

Also provided in another aspect of the present invention is a fabric that has a plurality of yarns that are formed into a 3/1 or a 4/1 twill weave face with a satin face. The fabric has at least 110 ends that are single-ply. The fabric has a width of at least 102 inches and is seamless.

An additional aspect exists as previously mentioned in which the width of the fabric is 124 inches.

The present invention also provides for a method of forming a fabric that includes the step of providing a plurality of polyester yarn. The method also involves sewing and batching the yarn on an A-frame so that the fabric is formed with a width from 102 inches to 131 inches and with a 3/1 or 4/1 twill weave with a satin face. Sanding of the fabric is also employed at a speed of at least 20 yards per minute. Another step involves passing the fabric across a plurality of rolls that have a sand paper surface in which the rolls apply compression to the fabric. The fabric is further applied to a tenter frame so that the fabric is stretched by at least 2% of its relaxed length. Another step involves treating the fabric with an agent to improve pilling properties of the fabric. Further, the fabric is heated in an additional step to a temperature of at least 385 degrees Fahrenheit.

Another aspect of the present invention resides in a method as immediately discussed in which the passing step includes passing the fabric across a first roll that has a 120 grit sand paper surface that will rotate in a first direction. The first roll applies at least 3 inches of compression to the fabric. The passing step also includes passing of the fabric across a second roll that has a 100 grit sand paper surface and that rotates in a second direction. The second roll applies at least 7 inches of compression to the fabric. The fabric is further passed in the passing step across a third roll that has a 100 grit sand paper surface and that rotates in the second direction. The third roll applies at least 7 inches of compression to the fabric. The passing step also includes passing of the fabric across a fourth roll that has a 120 grit sand paper surface and that rotates in the first direction. The fourth roll applies at least 5 inches of compression to the fabric.

An additional aspect of the present invention is found in a method as previously discussed that further includes the step of moving the fabric at a speed from 15 to 35 yards per minute.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
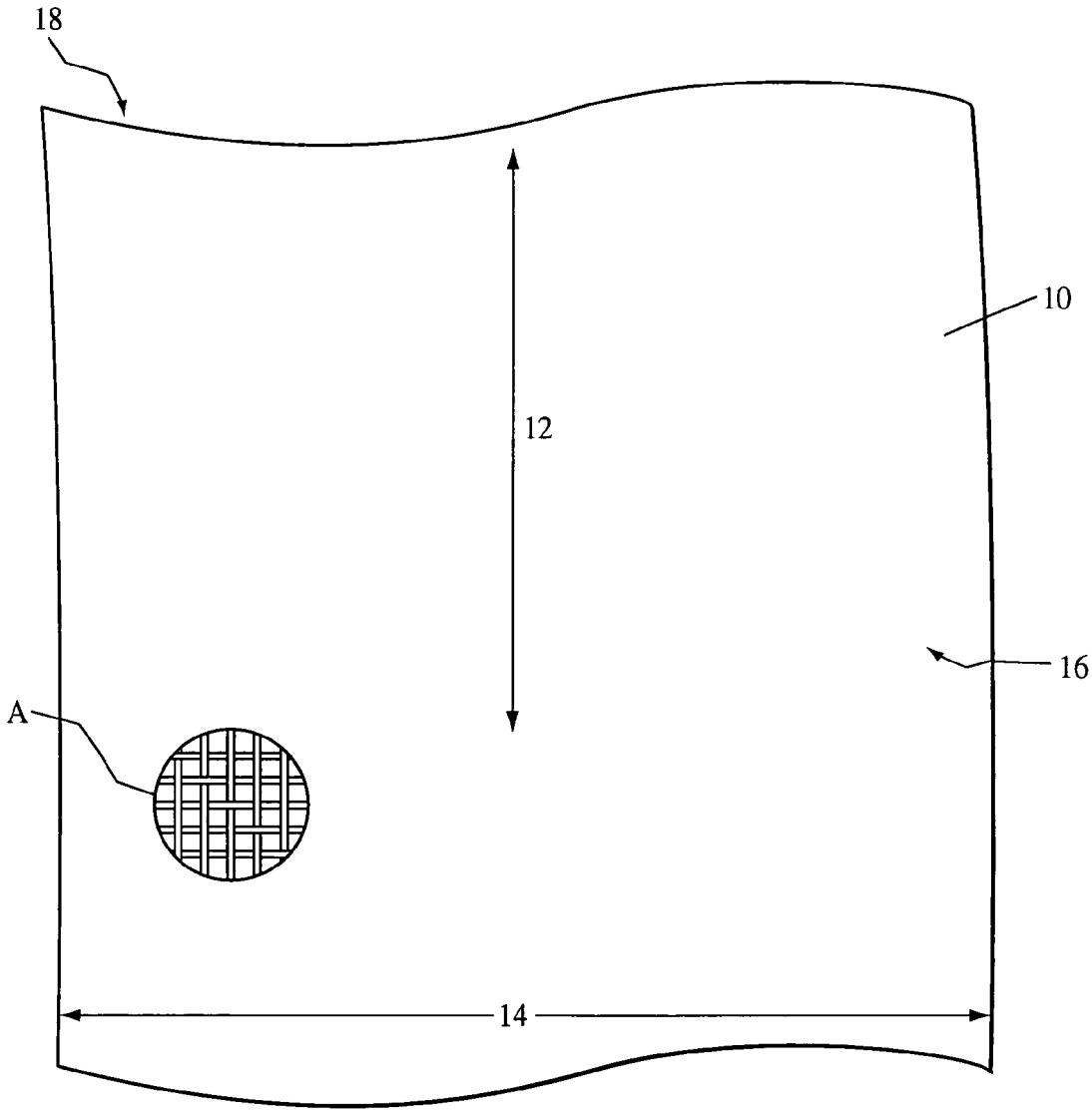
FIG. 1 is a perspective view of a fabric in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a fabric and a method of forming a fabric that has a twill weave with a satin face. The fabric can be formed with a float of 3/1 or 4/1 and may have a width of at least 102 inches, and preferably about 124 inches. Other embodiments exist in which the width may be from 102 inches to 131 inches.

The method, in accordance with one exemplary embodiment of the present invention, involves weaving on a loom a polyester warp yarn having about 140-150 denier with about 36-100 filaments in a single-ply form, although two-ply is possible in other embodiments. Also woven is a polyester two-ply yarn of about 140-150 denier weft yarn with between about 36-110 filaments and a pick count of 55. The fabric is woven at a width of about 124 inches. The yarn can be made from either plain polyester or may be made of 100% fire retardant polyester. Alternatively, the yarn can be made with a blend of fire retardant polyester and plain polyester, which is useful for heat transfer printing of fabrics.

The yarn may be put through a sewing and batching process on an A-frame. Here, the yarn is formed into a fabric such as a 3/1 or 4/1 twill weave that has a satin face. The ends of the fabric are single ply in one embodiment. Further, 110 or more ends may be present in accordance with other exemplary embodiments. The warp yarns of the fabric are oriented in the length-wise direction and extend in the machine direction during subsequent processing. The weft yarns of the fabric extend in the cross-direction and hence along the width of the fabric. The width of the fabric may be from 102 to 131 inches in accordance with certain exemplary embodiments. In accordance with one exemplary embodiment, the width of the fabric is 124 inches.

Following weaving, the fabric is then typically taken to a second location and subjected to various procedures such as finishing or preparation steps using conventional protocols. In such procedures the fabric may be, for example, dyed and/or treated so as to be fire retardant. Thereafter, in a subsequent treatment step, the fabric is sanded at a rate of 20 yards per minute. However, it is to be understood that sanding at different rates may be employed in other embodiments. For example, the fabric can be sanded at a rate up to 30 yards per minute or may sanded at a rate up to 15 yards per minute. The longer floats of the fabric result in ends that are not tied down and hence sand more evenly to achieve a more desirable fabric finish.

Sanding is accomplished by passing the fabric surface(s) over a plurality of rollers. The rollers can be provided with a rough surface for treating the fabric. For example, the rollers can have sand paper surfaces in one embodiment. In accordance with one exemplary embodiment of the present invention four rollers with sand paper surfaces are used in order to treat the fabric. However, it is to be understood that any number of rollers can be used in other embodiments and that their surfaces need not be rough. In one embodiment, the fabric is passed over a first roller that rotates in a first direction and has a 120 grit sand paper surface. The first roller presses onto the fabric surface in order to cause 3 inches of compression thereto.

A second roller can be employed and may have a 100 grit sand paper surface. The second roller can rotate in a direction opposite to the first roller and may be tensioned against the fabric so as to cause 7 inches of compression thereto. A third roller may also be employed and can have a 100 grit sand paper surface. The third roller may, as with the second roller, rotate in a second direction. The third roller is tensioned against the fabric in order to cause 7 inches of compression. The fabric may also be passed over a fourth roller that has a 120 grit sand paper surface. The fourth roller, like the first roller, rotates in the first direction. The fourth roller is configured in order to be urged against the fabric so as to cause 5 inches of compression thereto.

The first direction that the first and fourth rollers rotate may be the counter clockwise direction. The second direction in which the second and third rollers rotate can be opposite that of the first direction and may be in the clockwise direction. In other versions of the present invention, the first, second, third and fourth rollers may rotate in directions other than those disclosed above. The rollers can be driven so they urge the fabric in the machine direction. Alternatively, the rollers can be free turning so they do not act to urge the fabric in the machine direction. In other configurations, some of the rollers may be driven while others are free turning. Further, although described as having sand paper surfaces, the rollers need not actually have sand paper applied thereto. Instead, the surfaces of the rollers may be rough so as to result in possessing a grit quality much like a piece of sand paper. Although described as imparting a certain amount of compression onto the fabric, the rollers may apply various amount of compression in other embodiments. Additionally, one or more of the rollers need not apply any amount of compression in other versions of the disclosed method.

Heretofore, efforts to sand large width fabrics, defined here as fabrics having a width equal to or in excess of 102 inches have not been commercially viable. Variations in the tension of the fabric and uniformity of the sanding rollers results in uneven areas of the fabric. It has been found that in accordance with the present invention using an exemplary fabric as described above, including fabrics which have been dyed or treated with fire retardant coatings, a large width fabric, such as a 124 inch width fabric can be sanded to result in a fabric having a high quality hand with a uniform finish from edge to edge.

After sanding, the fabric is placed on a tenter frame and stretched a certain percentage of the fabric's relaxed length. For example, the fabric may be stretched 2% of the fabric's relaxed length. The fabric may be stretched along its width. As previously mentioned, the lengthwise direction of the fabric is in the same direction in which the warp yarns extend and is in the same direction as the machine direction of the rollers. The width of the fabric is perpendicular to the lengthwise direction of the fabric and is in the same direction as that in which the weft yarns extend.

In the disclosed method, the fabric can be treated once the fabric is applied to the tenter frame. For example, an agent may be applied to the fabric in order to improve various properties of the fabric such as soil release and pilling. In accordance with one exemplary embodiment, a chemical agent such as 2% LUBRIL® can be applied to the fabric after the fabric is applied to the tenter frame in order to improve soil release and improve pilling properties of the fabric. 2% LUBRIL® is distributed by Resolution Specialty Materials having offices located at 200 Railroad Street, Roebuck, S.C. 29376. The soil release property of the fabric relates to the ease with which dirt and other unwanted particles can be removed from the fabric upon washing. When used in items such as clothing and curtains, it is desirable for the article to easily release dirt contained thereon during cleaning. The pilling property of the fabric relates to the tendency of fibers of the fabric to interlock or knot with one another so as to form clumps on the surface of the fabric. Again, it is usually desirable for fabric used in applications such as clothing and curtains to have a minimum of pilling. Although described as being used in order to improve the soil release and pilling properties of fabric, it is to be understood that in other embodiments different types of agents may be applied to the fabric in order to modify other properties of the fabric.

While on the tenter frame, the fabric may be moved at a speed from 15 to 35 yards per minute. Other speeds are possible in other versions of the method. For example, the fabric may be moved at speeds up to 75 yards per minute in other embodiments.

The fabric is also heated to a temperature of 385 degrees Fahrenheit during application of the agent to the fabric. Heating of the fabric during application of the agent may act to impart durability and optimize performance of the agent. In other embodiments, the fabric may be heated before, after and/or during application of the agent. Further, the temperature to which the fabric is heated may vary. For example, the fabric may be heated to a temperature of from 380-420 degrees Fahrenheit. The tenter frame holds the fabric and maintains its stretch so that when dried the fabric does not shrink.

By employing rollers and a tenter frame that have elongated widths, the fabric is capable of being formed so that its width is about 124 inches. As such, the fabric can be formed with a desired width for a particular application without the need to sew two or more pieces of fabric together to achieve the desired width. This ability may be advantageous in that print patterns on two or more pieces of fabric do not need to be aligned with one another in forming a resultant fabric with a desired width. Further, as the fabric can be made to have a desired width the fabric can also be made without the presence of seams.

FIG. 1 shows a fabric 10 in accordance with one embodiment of the present invention. The fabric 10 can be used in constructing a wide variety of articles. For example, fabric 10 may be incorporated into curtains, clothing and/or covers. As shown, the fabric 10 has a longitudinal direction 12 that is perpendicular to the width 14 of the fabric 10. The longitudinal direction 12 may be in the same direction as is the machine direction during construction of the fabric 10. The width 14 is at least 102 inches and may be 124 inches in one embodiment. The face 16 of the fabric 10 is typically flat, lustrous and smooth and the fabric 10 is constructed with a twill weave with a satin face. The face 16 may be a relatively shiny surface if the yarns making up the fabric 10 are smooth and shiny. The weave pattern of yarns making up the fabric 10 may cause the face 16 to have different properties than the backside. However, the backside 18 may be treated the same as or differently from the face 16 so that properties of both the face 16 and backside 18, such as hand and shininess, may be the same as one another or different.

Figure 2:
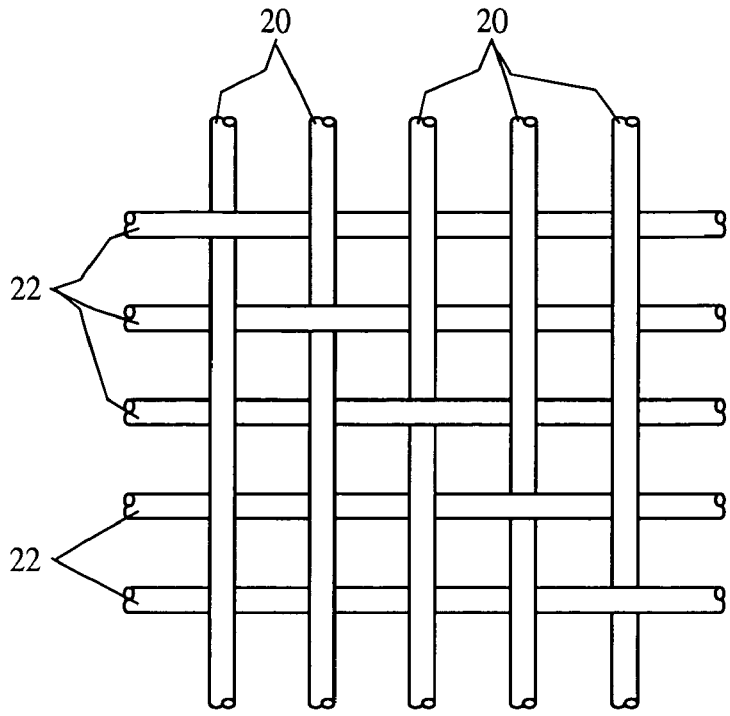
FIG. 2 is an enlarged plan view of circle A in FIG. 1 that shows the weave pattern of the fabric.

FIG. 2 is an enlarged view of the weave pattern noted in circle A of FIG. 1. The warp yarns 20 are arranged substantially parallel to one another and extend in the longitudinal direction 12 of fabric 10. The warp yarns 20 are arranged in such a pattern so as to lay over four weft yarns 22 and then under one weft yarn 22. The weft yarns 22 are oriented substantially parallel to one another and extend in the width 14 direction of fabric 20. As shown, the warp yarns 20 are arranged in a perpendicular fashion to the weft yarns 22. The weave pattern shown in FIG. 2 may repeat throughout the rest of fabric 10 and is known as a 4/1 twill weave with a satin face. The float of fabric 10 is 4/1 because the warp yarn 20 overlays four weft yarns 22 before laying under one weft yarn 22.

Figure 3:
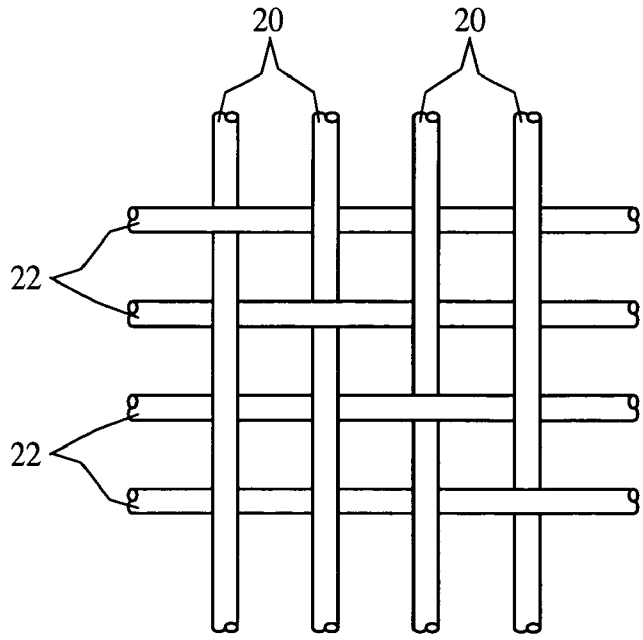
FIG. 3 is an enlarged plan view of the weave pattern of the fabric in accordance with an alternative exemplary embodiment of the present invention.

FIG. 3 shows an alternative exemplary embodiment of the fabric 10 in accordance with the present invention that displays the weave pattern of fabric 10. As with the embodiment in FIG. 2, the warp yarns 20 are parallel to one another and oriented in the longitudinal direction 12. The weft yarns 22 are likewise parallel to one another and are oriented in the direction of the width 14 of fabric 10. In this embodiment, the warp yarns 20 are arranged so as to lay over three weft yarns 22 and then under one weft yarn 22. The weave pattern shown in FIG. 3 may repeat through the entire fabric 10 and is known as a 3/1 twill weave with a satin face.

Twill weave fabrics with a satin face generally have fewer interlacings and allow for more yarns per square inch to be used. These types of weaves also normally result in fabrics with better hand properties, more wrinkle resistance, more soil resistance, and more durability than plain weave fabrics. Also, twill weave fabrics with a satin face tend to have a more defined face and backside.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

Experiments Carried Out in Accordance with Various Exemplary Embodiments of the Present Invention Experiments were conducted in accordance with various exemplary embodiments of the present invention. One such experiment measured the amount of pilling of the fabric. Pilling of the fabric involves the formation of fuzz balls on the face of the fabric that are formed by abrasion. A rating system is used in order to evaluate the pilling properties of a particular fabric:

| Rating of Pilling | Description of Pilling |
|---|---|
| Class 5 | No Pilling |
| Class 4 | Slight Pilling |
| Class 3 | Moderate Pilling |
| Class 2 | Severe Pilling |
| Class 1 | Very Severe Pilling |

Several specimens were tested to evaluate pilling properties as per an ASTM D 3512 testing procedure which is a standard test method for pilling resistance and other related surface changes of textile fabrics. This test method is sometimes known as a random tumble filling tester method. The specimens were treated in a manner as disclosed in the present application. The results were as follows:

| Specimen | Rating After 30 Minutes |
|---|---|
| 1 | Class 5* |
| 2 | Class 5* |
| 3 | Class 5* |

Although the 3 specimens tested that were made in accordance with the present invention rated as a class 5, they were found to have a slight degree of fuzzing of their outer surface.

Additional experiments were carried out on fabrics produced in accordance with the method of the present application. Further experiments were directed towards evaluating the wetting property of the fabric. Wetting is a test of the ability of water or another cleaning liquid to pass through the fabric. A rating system was used to evaluate the property of wetting:

| Wetting Score | Description |
|---|---|
| 100 | No Sticking or Wetting of Upper Surface |
| 90 | Slight Random Sticking or Wetting of Upper Surface |
| 80 | Wetting of Upper Surface at Spray Points |
| 70 | Partial Wetting of Whole of Upper Surface |
| 50 | Complete Wetting of Whole of Upper Surface |
| 0 | Complete Wetting of Whole Upper and Lower Surfaces |

A spray test was performed using an AATCC test method 22. Here, water was sprayed against a taut surface of the test specimen under controlled conditions to produce a wetted pattern. The wetted pattern was compared with pictures on a standard chart in order to accomplish the evaluation. The results were as follows:

| Specimen | Rating |
|---|---|
| 1 | 0 |
| 2 | 0 |
| 3 | 0 |

The wetting properties of fabric made in accordance with the present invention were found to have a wetting score of 0.

An additional experiment was carried out on fabric made in accordance with the present invention to determine fire retardance of the fabric. The test performed was an NFPA 701-2004 TM#1 which is a 2004 edition standard fire test for flame propagation of textiles and films. The minimum requirement for contract drapery is the NFPA 701 testing method. The fabric tested was configured as a single layer and the test results on the fabric were reported immediately after the flame test was conducted so that the fabric was not laundered before its evaluation. The test results were as follows:

| Specimen | Afterflame* (seconds) | Flaming Drip (seconds) | Weight Loss (percent) | Flame projects Above Top of Specimen (yes/no) |
|---|---|---|---|---|
| 1 | 0.0 | 0.0 | 24.1 | No |
| 2 | 29.7 | 10.0 | 18.3 | No |
| 3 | 14.1 | 2.3 | 25.2 | No |
| 4 | 0.0 | 0.0 | 24.8 | No |
| 5 | 0.0 | 0.0 | 24.5 | No |
| 6 | 10.5 | 0.0 | 31.2 | No |
| 7 | 0.0 | 2.3 | 29.5 | No |
| 8 | 0.0 | 0.0 | 17.3 | No |
| 9 | 0.0 | 0.0 | 14.8 | No |
| 10 | 0.0 | 0.0 | 13.1 | No |
| | | Mean: 1.5 | Mean: 22.3 | |

The weight loss had a standard deviation (SD) of 6.1 so that 3×SD=18.3. The Mean+(3×SD)=40.6. The approximate weight of the material was measured to be 219 g/m$^3$. The specimens were prepared in the length direction and were preconditioned for a length of time of 30 minutes at a temperature of 220° F. A conversion factor of g/m$^3$+28.35×0.835=oz/yd$^2$ was used.

Failure criteria under the selected test method is as follows:

| | | Weight Loss (percent) | |
|---|---|---|---|
| Afterflame | Flaming Drip Mean | Mean - | Individual Specimen |
| * | Exceeds 2 seconds | Exceeds 40% | Exceeds Mean + 3 SD |

Based on the failure criteria, the tested specimens pass the NFPA 701-2004 Edition test.

A revised failure criteria was also considered as follows:

| | Flaming Drip | Weight Loss | | Flame Height (Individual |
|---|---|---|---|---|
| Afterflame | Mean | Mean | Ind. Spec. | Specimen) |
| * | Exceeds 2 seconds | Exceeds 40% | Exceeds 50% | Projects above top of specimen |

In a similar manner, the specimens pass under the revised failure criteria. Although the NFPA document does not factor * Afterflame into the failure criteria reporting requirements, afterflame is recorded. It should be noted that excessive afterflame (15 seconds or more) may be cause for rejection of the product by local fire authorities performing "match" field tests.

Another test was carried out on fabric produced in accordance with the present invention to determine tearing strength. The test used was the ASTM D 2261 test which is a standard test method for tearing strength of fabrics by the tongue (single rip) procedure. The type of machine used in the test is a constant rate of extension tensile testing machine. Results of the test are as follows:

| Specimen # | Strength Across Warp (lbs) | Strength Across Fill (lbs) |
|---|---|---|
| 1 | 30.5 | 27.5 |
| 2 | 31.0 | 29.0 |
| 3 | 33.5 | 31.5 |
| 4 | 27.5 | 32.0 |
| 5 | 27.0 | 32.5 |
| | Average 29.9 | Average 30.5 |

Additional experiments were carried out in order to determine the breaking force of the fabric. The test method employed was the ASTM D 5034 test method that is sometimes known as the grab test and is a standard test method for measuring the breaking force of textile fabrics. The results of this test are as follows:

| Direction | Specimen # | Force (lbs) |
|---|---|---|
| Warp | 1 | 210 |
| Warp | 2 | 210 |
| Warp | 3 | 212 |
| Warp | 4 | 214 |
| Warp | 5 | 220 |
| | | Average 213 |
| Fill | 1 | 206 |
| Fill | 2 | 222 |
| Fill | 3 | 208 |
| Fill | 4 | 228 |
| Fill | 5 | 224 |
| Fill | 6 | 240 |
| Fill | 7 | 242 |
| Fill | 8 | 247 |
| | | Average 227 |

Additional testing of the fabric was conducted. This additional test was the AATCC test method 135 that ascertained dimensional changes in automatic home laundering of woven and knit fabrics. The fabric was subjected to both one and five laundering cycles and a wash load of four pounds was used. The washing machine used was set at a normal/ctn/sturdy setting with a wash temperature of 160° F.+/−5° F. with a tumble dry of cotton/sturdy. The results are as follows (− indicating shrinkage and + indicating growth):

| Results after 1 cycle | | Results after 2 cycles | |
|---|---|---|---|
| (% change) Length | (% change) Width | (% change) Length | (% change) Width |
| −0.5 | 0.0 | −0.5 | 0.0 |
| −0.5 | 0.0 | −0.5 | 0.0 |
| −0.5 | 0.0 | −0.5 | 0.0 |
| Average: −0.5 | Average 0.0 | Average −0.5 | Average 0.0 |

The ASTM D 4157-02 test was also conducted which is a standard test method for measuring abrasion resistance of textile fabrics and is sometimes known as an oscillatory cylinder method. Wire (steel) screen was selected as an abradant. The surface category into which the fabric falls is a special surface effect which is used for napped, chenille, embossed, textured and like fabrics. The specimen was tensioned at 4 pounds and a head pressure of 3 pounds was applied. The rating system special surface effects are as follows:

5—None or negligible wear/change of special surface effect

4—Slight wear/change of special surface effect

3—Moderate wear/change of special surface effect

2—Noticeable wear/change of special surface effect (base yarns exposed)

1—Severe wear/change of special surface effect (base yarns exposed and broken)

The test results obtained through visible observations are as follows:

| Number of Double Rubs | Length Specimens | Width Specimens |
|---|---|---|
| 3,000 | 4.5-5.0 | 4.5-5.0 |
| 9,000 | 4.0 | 4.0 |
| 15,000 | 3.5-4.0 | 3.5-4.0 |
| 22,500 | 3.0-3.5 | 3.0-3.5 |
| 30,000 | 3.0 - Moderate loss of surface texture | 3.0 - Moderate loss of surface texture |

Class 3 is generally considered to be the minimum passing rate for heavy duty commercial upholstery. Light duty upholstery standards are typically 9,000 rubs with class 3 performance.

What is claimed:

1. A method of finishing a fabric having a twill weave with a satin face, comprising the steps of:

providing a fabric having a width from 102 to 131 inches;

sewing and batching said fabric on an A-frame;

passing said fabric at a speed of 20 yards per minute with a first roll having a 120 grit sand paper surface and rotating in a counter clockwise direction, wherein said first roll applies 3 inches of compression to said fabric;

engaging said fabric with a second roll having a 100 grit sand paper surface and rotating in a clockwise direction, wherein said second roll applies 7 inches of compression to said fabric;

engaging said fabric with a third roll having a 100 grit sand paper surface and rotating in a clockwise direction, wherein said third roll applies 7 inches of compression to said fabric;

engaging said fabric with a fourth roll having a 120 grit sand paper surface and rotating in a counter clockwise direction, wherein said fourth roll applies 5 inches of compression to said fabric;

applying said fabric to a tenter frame;

stretching said fabric by 2% of said fabric's relaxed length;

moving said fabric at a speed from 15 to 35 yards per minute; and applying an agent to said fabric to improve pilling properties of said fabric;

heating said fabric to a temperature of 385 degrees Fahrenheit.

2. The method as in claim 1, wherein said fabric has a float selected from the group consisting of 3/1 and 4/1.

3. A method of forming a fabric, comprising the steps of:

providing a plurality of yarn;

batching said yarn on an A-frame such that said fabric is formed having a width greater than 102 inches and having a twill weave with a satin face;

passing said fabric across a plurality of rolls that have a rough surface, wherein said rolls apply compression to said fabric;

applying said fabric to a tenter frame; and heating said fabric.

4. The method as in claim 3, further comprising the step of sanding said fabric at a speed of 20 yards per minute.

5. The method as in claim 3, wherein said passing step comprising:

passing said fabric across a first roll having a 120 grit sand paper surface and rotating in a first direction, wherein said first roll applies at least 3 inches of compression to said fabric;

passing said fabric across a second roll having a 100 grit sand paper surface and rotating in a second direction, wherein said second roll applies at least 7 inches of compression to said fabric;

passing said fabric across a third roll having a 100 grit sand paper surface and rotating in the second direction, wherein said third roll applies at least 7 inches of compression to said fabric; and passing said fabric across a fourth roll having a 120 grit sand paper surface and rotating in the first direction, wherein said fourth roll applies at least 5 inches of compression to said fabric.

6. The method as in claim 5, wherein the first direction is counter clockwise and wherein the second direction is clockwise.

7. The method as in claim 3, wherein said applying step comprising stretching said fabric by 2% of said fabric's relaxed length.

8. The method as in claim 3, further comprising the step of applying an agent to said fabric to improve soil release and pilling properties of said fabric.

9. The method as in claim 3, wherein after said batching step said fabric is moved at a speed from 15 to 35 yards per minute.

10. The method as in claim 3, wherein said heating step is performed such that said fabric is heated to a temperature of 385 degree Fahrenheit.

11. The method as in claim 3, wherein said fabric is formed in said batching step so as to have a float of 3/1.

12. The method as in claim 3, wherein said fabric is formed in said batching step so as to have a float of 4/1.

13. The method as in claim 3, wherein the width of said fabric is 124 inches.

14. A method of forming a fabric, comprising the steps of:

providing a plurality of polyester yarn;

sewing and batching said yarn on an A-frame such that said fabric is formed having a width from 102 inches to 131 inches and having a 3/1 or 4/1 twill weave with a satin face;

sanding said fabric at a speed of at least 20 yards per minute;

passing said fabric across a plurality of rolls that have a sand paper surface, wherein said rolls apply compression to said fabric;

applying said fabric to a tenter frame such that said fabric is stretched by at least 2% of said fabric's relaxed length;

treating said fabric with an agent to improve pilling properties of said fabric; and heating said fabric to a temperature of at least 385 degrees Fahrenheit.

15. The method as in claim 14, wherein said passing step comprising:

passing said fabric across a first roll having a 120 grit sand paper surface and rotating in a first direction, wherein said first roll applies at least 3 inches of compression to said fabric;

passing said fabric across a second roll having a 100 grit sand paper surface and rotating in a second direction, wherein said second roll applies at least 7 inches of compression to said fabric;

passing said fabric across a third roll having a 100 grit sand paper surface and rotating in the second direction, wherein said third roll applies at least 7 inches of compression to said fabric; and passing said fabric across a fourth roll having a 120 grit sand paper surface and rotating in the first direction, wherein said fourth roll applies at least 5 inches of compression to said fabric.

16. The method as in claim 14, further comprising the step of moving said fabric at a speed from 15 to 35 yards per minute.

* * * * *